United States Patent [19]

Scharen

[11] 4,173,966

[45] Nov. 13, 1979

[54] SELF-CONTAINED HEATING APPARATUS

[76] Inventor: Richard O. Scharen, 461 Blackstone, Springfield, Oreg. 97477

[21] Appl. No.: 796,854

[22] Filed: May 16, 1977

[51] Int. Cl.[2] ..... F24B 7/04

[52] U.S. Cl. ..... 126/121; 237/51

[58] Field of Search ..... 126/121, 123; 237/51

[56] References Cited

U.S. PATENT DOCUMENTS

| | | | |
|---|---|---|---|
| 2,134,935 | 11/1938 | Winnett | 126/121 |
| 2,642,859 | 6/1953 | Brown | 126/121 |
| 2,671,440 | 3/1954 | Dupler | 126/121 |
| 3,987,778 | 10/1976 | Brik | 126/121 |
| 4,019,492 | 4/1977 | Rush | 126/121 |
| 4,026,264 | 5/1977 | Henriques | 126/121 X |
| 4,059,090 | 11/1977 | Shaw | 126/121 |

*Primary Examiner*—Allen M. Ostrager

*Attorney, Agent, or Firm*—Kolisch, Hartwell, Dickinson & Stuart

[57] ABSTRACT

A self-contained heating apparatus adapted for mounting in a fireplace includes an air chamber surrounding a combustion chamber. An air mover is provided for circulating air through the air chamber and outwardly from air ducts which extend across the combustion chamber.

2 Claims, 4 Drawing Figures

SELF-CONTAINED HEATING APPARATUS

BACKGROUND AND SUMMARY OF THE INVENTION

The present invention relates to heating apparatus and more particularly to a self-contained heating apparatus which may be adapted for positioning within a fireplace for converting the fireplace into a forced air heating unit.

Prior art heating apparatus may take the form of a stove in which a combustion chamber is provided for the burning of combustible material. Heat produced in the combustion chamber is radiated outwardly through the sides of the stove in order to heat a selected room area or space. The heat given off does not circulate adequately, and therefore it has been proposed to provide ducts within such stoves in order to provide conduits by which air could be more readily distributed into a space. However, it has been found that the design of such stoves suffers from certain drawbacks.

Specifically, it has been found that the stoves are not constructed so that air is fully pre-heated before it is circulated through the ducts. Thus, from a heat transfer standpoint, the air does not pick up adequate heat and cool air may tend to circulate.

Other proposals have considered mounting a unit within a fireplace to convert the fireplace into a forced air unit. However, it has been found difficult to provide units which will adequately transfer heat from the fireplace mounted unit so that the heat is distributed effectively within a space.

Accordingly, it is a general object of the present invention to provide a self-contained heating apparatus or unit which utilizes a combustion chamber substantially surrounded by an air chamber which pre-heats air before the air is forced through plural air ducts which extend through the combustion chamber. An air mover means is used to circulate air through the air chamber and outwardly through the air ducts. Complete and effective heat transfer from the combustion chamber to the discharged air is ensured.

Another object of the present invention is to provide a self-contained heating apparatus which may be readily mounted into a fireplace opening to convert the fireplace into a forced air heating system.

Still another object of the present invention is to provide a self-contained heating apparatus which is provided with an external configuration which permits ready and unobtrusive mounting into a fireplace.

These and additional objects and advantages of the present invention will be more readily understood from a consideration of the following drawings and a detailed description of the preferred embodiments.

DETAILED DESCRIPTION OF THE PREFERRED EMBODIMENTS

Figure 3:
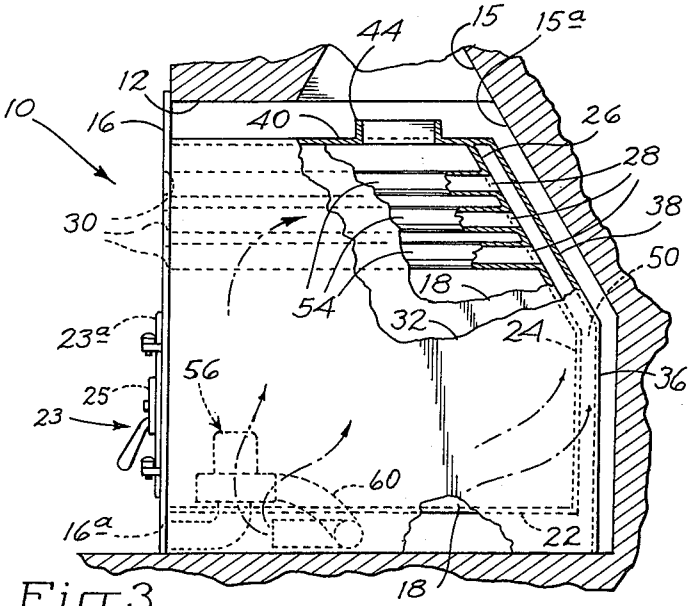
FIG. 3 is a side elevation view, partially broken away taken along lines 3—3 of FIG. 1.
Figure 1:
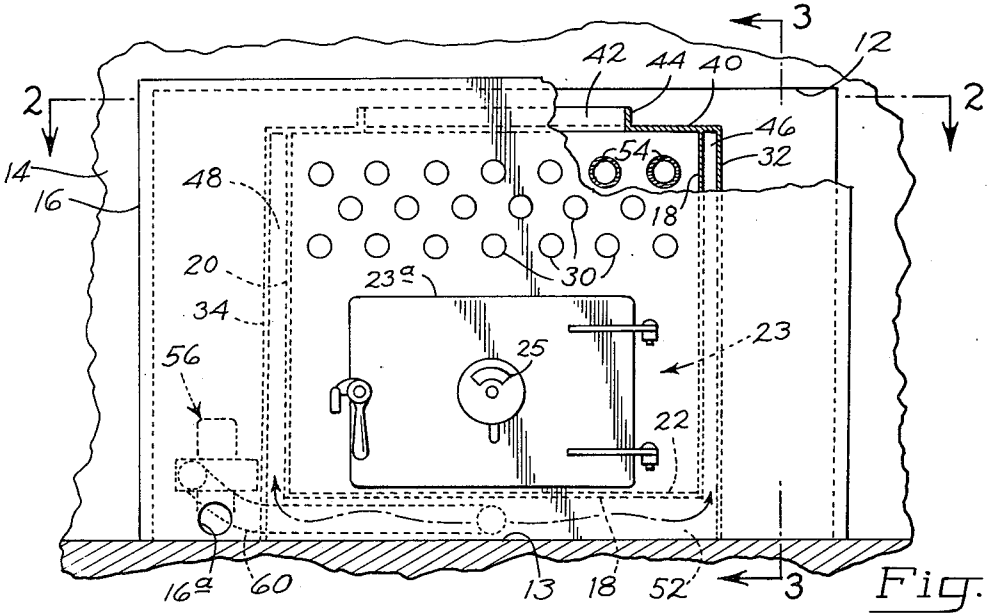
FIG. 1 is a front elevation view showing only a portion of a fireplace with a heating appartus according to the present invention, partially cut away, mounted in the fireplace.

Turning now to the drawings, and referring initially to FIG. 1, there is indicated generally at 10 a self-contained heating apparatus according to the present invention. Apparatus 10 is shown mounted within an opening 12 of a fireplace, the floor being indicated at 13 and the front at 14. As shown in FIG. 3, a chimney is indicated at 15 and a sloped back wall at 15*a*.

Figure 2:
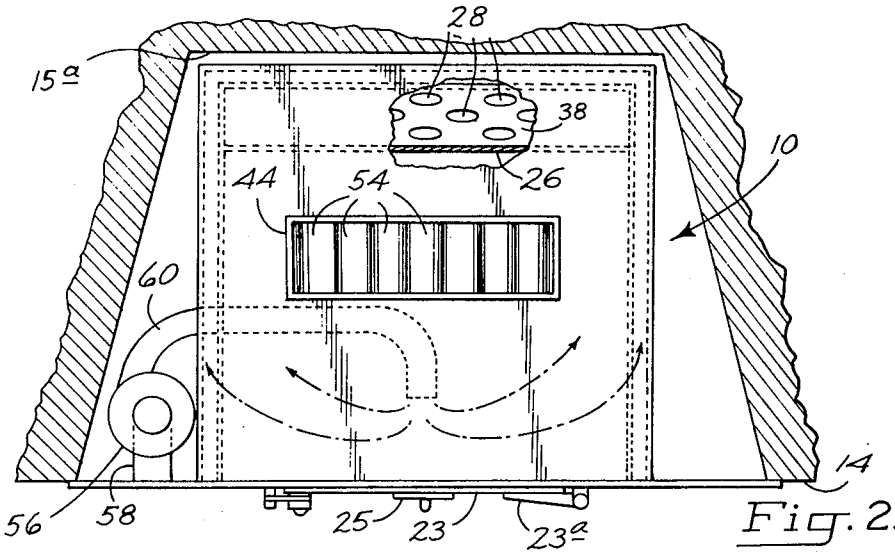
FIG. 2 is a top plan view of the apparatus taken along lines 2—2 of FIG. 1.

Apparatus 10 includes a front plate 16 and opposed, spaced apart side walls 18, 20. Side walls 18, 20 are secured at their forward edges (as by welding, etc.) to a back side of plate 16 and are interconnected by a bottom plate 22. As shown in FIGS. 2 and 3, a rear wall interconnects the rear of side walls 18, 20 and includes a vertically upstanding portion 24 and an inclined portion 26 sloped toward front plate 16. Inclined portion 26 is provided with a plurality of openings 28 which are aligned with corresponding openings 30 provided in front plate 16. The function of the openings will be more fully described at a later point.

Front plate 16, side walls 18, 20 and rear wall portions 24, 26 together with bottom plate 22 provide a burning region or combustion chamber 23. Combustible material may be placed on bottom plate 22 through a latched access door shown at 23*a*. An air adjustment damper 25 is also provided.

Spaced from side wall 18 is an outer wall 32 which also has it front edge mounted to front plate 16 and extends below bottom plate 22. Another outer wall 34 is spaced from side wall 20 and is mounted to front plate 16 with a bottom portion thereof extending below bottom plate 22. Connected to a rearward portion of outer walls 32, 34 is a back wall having portions 36, 38 which substantially parallel portions 24, 28 respectively. Back wall protion 36 also extends below bottom plate 22 an amount equal to the extension of outer walls 32, 34.

A top cover plate 40 or wall includes an opening 42 for accommodating a flue 44. Cover plate 40 is secured to front plate 16 and is also secured to side walls 18, 20 and outer walls 32, 34. Further, cover plate 40 is secured to upper edges of inclined portion 26 and back wall portion 38.

From the above description, it can be seen that an air chamber is provided between the side walls and the outer walls. For instance, an air chamber 46 is provided between side wall 18 and outer wall 32 and an air chamber 48 is defined between side wall 20 and outer wall 34. A rear air chamber 50 is provided at the rear of apparatus 10. Furthermore, it is to be noted that with apparatus 10 mounted as shown in FIGS. 1–3, an air chamber 52 is defined between bottom plate 22 and floor 13 of the fireplace. Thus, it can be appreciated that combustion chamber 23 is substantially encompassed by an air chamber or air spaces about its sides, bottom and rear.

As more clearly shown in FIG. 3, multiple tubular air ducts 54 extend between correspondingly aligned openings 28, 30. Air ducts 54 are positioned in a staggered relationship as shown in FIG. 1. It is contemplated that air ducts 54 will be disposed somewhat above bottom plate 22 so that adequate room for placement of fuel on bottom plate 22 will be provided.

An air mover means, generally designated at 56, is provided for drawing air from an external space and circulating it through the air chambers and outwardly through air ducts 54 into a space to be heated. Specifically, air mover means 56 may be of the so-called blower type and includes an inlet duct 58 extending through an opening 16a provided in front plate 16. A discharge duct 60 leads from a discharge port of air mover means 56 and extends into air chamber 52. A front portion of duct 60 may be positioned for discharging air toward the front of apparatus 10.

Figure 4:
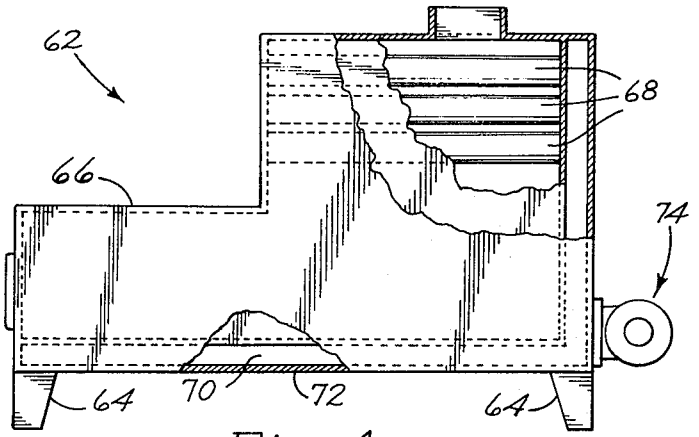
FIG. 4 is a side elevation view, partially broken away, of a second embodiment of the present invention.

Another embodiment of the present invention is illustrated in FIG. 4. As shown in side elevation view, a self-contained heating apparatus 62 is constructed similarly to apparatus 10, but includes support legs 64 and a heating or cooking surface 66. Surface 66 is disposed in front of the openings for discharge from tubular ducts 68. It can be seen that heating apparatus 62 includes spaced-apart upper and lower front walls vertically staggered so that surface 66 is positioned beneath the discharge openings of ducts 68. A bottom plate is shown at 67.

Air chambers are provided at the rear and sides of apparatus 62 similar in construction to that of apparatus 10. However, if a bottom air chamber is provided, as shown at 70, it is necessary to provide a second bottom plate 72 beneath bottom plate 67. An air mover means is mounted on the rear of apparatus 62 and is indicated at 74.

Operation

The use of apparatus 10 to effectively heat a space will now be described. Use of apparatus 62 is substantially similar. Depending upon fireplace dimensions, apparatus 10 is provided with front plate 16 dimensioned to overlap the opening of the fireplace. Apparatus 10 may then be shifted into the opening so that side portions of front plate 16 contact and overlap the front opening of the fireplace. Some appropriate type of seal may be used if desired.

Apparatus 10 is contemplated as occupying a major volume of the fireplace chamber and the inclined rear walls permit a relatively snug, accommodating fit. Combustible material is situated upon bottom plate 22 and ignited. After sufficient heat has built up, air mover means 56 is actuated and air is drawn from outside apparatus 10 for discharge through duct 60 initially into air chamber 52. The air is circulated through air chamber 52 and through air chambers 46, 48 and 50. The circulation is generally shown by the dot-dash arrows in FIGS. 1–3.

During such circulation, heat is transferred from the walls of combustion chamber 23 to the circulating air. As the circulating air moves upwardly to openings 28, it is continually receiving heat input. The circulating air is then transferred through openings 28 and is forced outwardly through openings along the lengths of air ducts 54. During travel of the preheated, circulating air through air ducts 54, additional heat is picked up due to the rising hot gases from combustion chamber 23 flowing upwardly through the chamber and outwardly through flue 44.

Due to the internal pressure built up by air mover means 56, considerable air flow may be discharged through openings 30 and provide considerable heat into a space to be warmed.

Several significant advantages of the present invention are readily apparent. By providing air chambers about a substantial portion of the combustion chambers and forcing air through these chambers permits the air to be pre-heated. Due to the pressure within the air chambers, the air is eventually channelled upwardly and forced through the air ducts. During travel through the air ducts, additional heat is transferred from the combustion chamber to the air. The resulting discharged air has received a significant amount of heat during its circulation in the unit. This heat is then effectively distributed to a space.

Furthermore, the apparatus of the present invention may be readily mounted within a fireplace. As shown in FIGS. 1–3, a bottom air chamber may be readily provided between the botttom of the unit and the fireplace floor. By providing an enlarged front plate, the apparatus may be unobtrusively situated in the fireplace. Also, the sloped or inclined rear walls permit the apparatus to occupy a substantial volume of the fireplace chamber.

While the invention has been particularly shown and described with reference to the foregoing preferred emobodiments, it will be understood by those skilled in the art that other changes in form and detail may be made without departing from the spirit and scope of the invention as defined in the appended claims.

It is claimed and desired to secure by Letters Patent:

1. A self-contained heating apparatus comprising:

a combustion chamber having spaced-apart and vertically staggered upper and lower front walls, side and rear walls and top and bottom walls, a flue extending upwardly from an opening in said top wall, an air chamber including outer side walls and an outer rear wall surrounding and spaced from said side and rear walls respectively, multiple air ducts disposed between said flue and said bottom wall which extend from openings in said rear wall to corresponding aligned openings in said upper front wall, said air ducts being in communication with said air chamber, a substantially horizontally arranged heating surface disposed forwardly of and beneath the discharge openings of said air ducts, and air mover means operable for circulating air through said air chamber for discharging the air through said air ducts outwardly from said upper front wall.

2. The apparatus of claim 1 wherein said air mover means is mounted on a rear portion of said outer wall.

* * * * *